United States Patent [19]

Meloy

[11] Patent Number: 4,539,179

[45] Date of Patent: Sep. 3, 1985

[54] METHOD FOR CLEANSING AND DISINFECTING TOILET TANKS AND BOWLS

[75] Inventor: Gilbert K. Meloy, Earlville, Ill.

[73] Assignee: Twinoak Products, Inc., Plano, Ill.

[21] Appl. No.: 565,720

[22] Filed: Dec. 27, 1983

Related U.S. Application Data

[62] Division of Ser. No. 364,786, Apr. 2, 1982, Pat. No. 4,435,857.

[51] Int. Cl.[3] ..... E03D 9/02

[52] U.S. Cl. ..... 422/28; 422/37; 422/266

[58] Field of Search ..... 4/222, 227, 228; 222/56, 57, 189, 190, 319, 453, 519, 562; 137/268; 422/264, 266, 277, 28, 37

[56] References Cited

U.S. PATENT DOCUMENTS

| | | | |
|---|---|---|---|
| Re. 11,941 | 10/1901 | Thomson | 4/228 |
| 607,818 | 7/1898 | Ashburner | 4/228 |
| 650,161 | 5/1900 | Williams et al. | 4/228 |
| 1,175,032 | 3/1916 | Williams | 4/228 |
| 1,307,535 | 9/1919 | Ciancaglini | 4/228 |
| 3,121,236 | 2/1964 | Yadro et al. | 4/228 |
| 3,339,801 | 9/1967 | Hronas | 222/57 |
| 3,407,412 | 10/1968 | Spear | 4/228 |
| 3,504,384 | 4/1970 | Radley et al. | 4/228 |
| 3,521,306 | 7/1970 | Jacobs | 4/228 |
| 3,545,014 | 12/1970 | Davis | 4/228 |
| 3,604,020 | 9/1971 | Moisa | 4/228 |
| 3,618,143 | 11/1971 | Hill et al. | 4/228 |
| 3,772,715 | 11/1973 | Nigro | 4/228 |
| 3,781,926 | 1/1974 | Levey | 4/228 |
| 3,837,107 | 9/1974 | McDuffee | 4/228 |
| 3,943,582 | 3/1976 | Daeninckx et al. | 4/228 |
| 4,171,546 | 10/1979 | Dirksing | 4/228 |
| 4,200,606 | 4/1980 | Kitko | 422/37 |
| 4,208,747 | 6/1980 | Dirksing | 4/228 |
| 4,216,027 | 8/1980 | Wages | 134/36 |
| 4,375,109 | 3/1983 | Jones | 4/228 |
| 4,432,102 | 2/1984 | Woodruff et al. | 4/227 |
| 4,436,269 | 3/1984 | Dirksing et al. | 4/228 |
| 4,438,534 | 3/1984 | Keyes et al. | 4/227 |

FOREIGN PATENT DOCUMENTS

| | | | |
|---|---|---|---|
| 2090884 | 7/1982 | United Kingdom | 4/227 |

*Primary Examiner*—Barry S. Richman
*Assistant Examiner*—Brion P. Heaney
*Attorney, Agent, or Firm*—McDougall, Hersh & Scott

[57] ABSTRACT

Method and apparatus for cleansing and disinfecting a toilet tank and toilet bowl by treating the water discharged from the toilet tank each time the toilet is flushed. A passive dosing dispenser that automatically dispenses a disinfectant with each flush is provided in the tank to carry out the cleansing and disinfecting method. The dispenser comprises a series of chambers in fluid communication including a reservoir containing the source of disinfectant, a vented volume control chamber, a delivery tube provided with a dispensing orifice in dynamic fluid communication with liquid in the toilet tank, and a vented standpipe. The respective chambers have volumes selected to provide a controlled dispensing action, and the arrangement of chambers is such that the concentration of the aqueous disinfectant solution discharged remains substantially constant upon repetitive flushing, and/or during extended quiescent periods. The dispenser can be provided with means responsive to toilet tank and toilet water contaminants that tend to interfere with the disinfectant dispensed.

13 Claims, 17 Drawing Figures

RETENTION OF DISINFECTANT ACTIVITY
AFTER CONSECUTIVE FLUSHES

METHOD FOR CLEANSING AND DISINFECTING TOILET TANKS AND BOWLS

This is a division of application Ser. No. 364,786 filed Apr. 2, 1982, now U.S. Pat. No. 4,435,857, issued Mar. 13, 1984.

FIELD OF THE INVENTION

The present invention pertains, in general, to a method and apparatus for cleansing and disinfecting a toilet comprising a toilet tank and a toilet bowl. Because the preferred dispensing apparatus employed is entirely passive—i.e., it has no moving parts, the present invention relates to an economical and reliable method and apparatus for disinfecting the toilet each time it is flushed. Furthermore, because a predetermined quantity of solution is discharged each time the toilet is flushed, even upon repetitive flushes, or with long quiescent periods between flushes, the apparatus and method provides a means for cleansing and disinfecting the toilet bowl which is particularly consistent over a suitable period of use. In order to achieve this consistent disinfecting, the dispenser also is provided with means for neutralizing certain minerals and contaminants found in the toilet and/or toilet water which tend to interfere with the disinfecting properties of the disinfectant.

DESCRIPTION OF THE PRIOR ART

Passive dosing dispensers are disclosed in various prior art patents. For instance, U.S. Pat. No. 650,161 issued to J. Williams, et al. and U.S. Pat. No. 1,175,032 issued to E. R. Williams disclose passive dispensers which are alternately flooded and then syphoned to a predetermined level. U.S. Pat. No. 3,772,715 issued to L. V. Nigro, U.S. Pat. No. 3,781,926 issued to J. Levey, and U.S. Pat. No. 3,943,582 issued to J. Daeninckx, et al, disclose passive dispensers which are alternately flooded and then gravitationally drained. U.S. Pat. No. 3,407,412 issued to C. T. Spear disclose dispensers which must be connected to a pressurized water supply such as the trap refill tube in a toilet tank. In these systems, the direction of flow alternates in labyrinth passages.

Various other devices for cleansing and disinfecting flushing toilets are also well-known in the art. U.S. Pat. No. 1,307,535 issued to Ciancoglini discloses dispensing a disinfectant into a flush tank-type toilet at the end of the flush cycle. U.S. Pat. No. 3,339,801 issued to Hronas discloses the introduction of various agents including detergents, biocides, corrosion inhibitors, scale inhibitors, deodorants, etc. into the flush tank as it fills, thus treating the entire water content of the tank. U.S. Pat. No. 3,121,236 issued to Yadro, et al. discloses dispensing into the toilet tank compositions containing such materials as silicates, phosphates, and carbonates to treat metal ions in the water and thereby provide rust and scale prevention. U.S. Pat. No. 3,504,384 issued to Radley, et al. discloses apparatus for separately dispensing a detergent composition and a disinfecting composition into the flush tank of a toilet.

U.S. Pat. No. Re. 11,941 to Thomson discloses a disinfecting device comprising a cone-shaped receptacle containing a disinfecting salt and adapted to be immersed in a flushing tank. The receptacle has perforations in its side and a solution including the disinfecting salt passes through the perforations during operation of the device. U.S. Pat. No. 3,521,306 issued to Jacobs discloses a device immersed in the water contained in a flush tank of a toilet fixture, for dispensing toilet fixture conditioning chemicals and fragrances in response to the ebb and flow of water in a flush tank.

U.S. Pat. No. 3,545,014 issued to Davis discloses a sanitizer for dispensing a chemical solution to water in the flush tank of a toilet. The sanitizer is partially immersed in the flush tank water in a flexible bag, the level of the water in the tank being between two bag openings, the lower of which lies above the level of the sanitizing material. U.S. Pat. No. 3,604,020 to Moisa discloses a dispenser package suspended in a toilet tank below the normal water level in the tank for dispensing sanitizing chemicals into the toilet tank upon each actuation of the toilet. The dispenser is provided with at least a pair of spaced openings, one adjacent the top of the package and the other slightly above the top level of the chemical formulation and below the top level of the package. A chemical formulation is disclosed which contains calcium hypochlorite, trisodium phosphate and, as dispenser aids, ground gravel and sodium chloride pellets.

U.S. Pat. No. 3,837,017 issued to McDuffee discloses a passive system for cleaning toilet bowls wherein a container for calcium hypochlorite is located within a water tank associated with the bowl. A small diameter opening is provided within the top wall of the container to provide exposure to water in the tank so that the compound will be dissolved in the water and thereby delivered to the bowl when the toilet is flushed. An amount of inert particles, such as stone, may be included in the container to cooperate with the small diameter opening for purposes of limiting the rate of removal of the compound from within the container.

In a series of more recently issued patents, there are described various passive dispensing apparatuses using air locks to control the amount of product dispensed; these systems are also designed to isolate the product from the toilet tank water. The systems are disclosed in U.S. Pat. No. 4,171,546 issued to Dirksing, U.S. Pat. No. 4,200,606 issued to Kitko, U.S. Pat. No. 4,208,747 issued to Kirksing and U.S. Pat. No. 4,216,027 issued to Wages; respectively. The Kitko '606 disclosure particularly discusses a system wherein a dye is provided for giving a persistent color to the bowl water between flushes. The objective is to assure a consumer that the bowl is being sanitized and means are provided to indicate the time when the disinfectant needs to be replaced. This is accomplished by eliminating the color signal.

BACKGROUND OF THE INVENTION

The role of aerosols in the epidemiology of disease transmission by toilets has been established. Specifically, it has been demonstrated experimentally that the flushing action of a contaminated toilet produced a bacterial aerosol comprised of particles of sizes which tend to persist in the air (aerosols) and which are capable of reaching the lower respiratory tract of humans as well as deposit in the nose, mouth and eyes, and which are capable of settling out upon surfaces routinely touched by the hands.

Other studies have demonstrated that the initial flush of a toilet, the bowl of which had been cleaned and then seeded with an over-night culture of *E. coli* or *E coli* bacteriophage MS-2 eliminated the major portion of the exogenously added organisms, but after subsequent repeated flushes, the number of residual organisms in the bowl, instead of being diminished, often increased. This increase was found to be due to the adsorption of the organisms to the procelain surfaces of the bowl, with a gradual elution occuring after each flush. In the case of both bacteria and viruses, the number of organisms in the bowl was found to reach a plateau below which their number could not be reduced by repeated flushing. It was further found that the flushing of toilets generated droplets (aerosols) which harbored both bacteria and viruses which had been seeded and which remained airborne long enough to settle on surfaces throughout a bathroom. The number of organisms ejected on flushing was found to be directly proportional to the number present in the bowl water at the time of the flush.

Periodic cleaning of domestic toilet bowls—i.e., twice a week or less, is considered inadequate to control microbial contamination of toilet bowls which are used with a higher frequency—i.e., about four or more times, in the course of a day. The reason for this is that although stains and microbial activity can be eliminated from a toilet bowl by periodic cleaning, the bowl is recontaminated by subsequent use. Thus, at best, periodic cleaning of a toilet bowl with a conventional in-bowl cleaning agent provides only temporary control of microbial activity.

It has been suggested that a potential for disease transmission exists due to the contamination of bathroom surfaces by aerosols generated on flushing of a contaminated toilet. It is recognized that there is a need for an effective means for providing automatic, reliable and consistent antimicrobial treatment of a toilet bowl.

Certain non-metered disinfectant dispensing apparatuses produce a build-up of disinfectant actives in the toilet tank over prolonged periods of quiescence, e.g. during vacations. Such build-up of disinfectants in the tank is wasteful and uneconomical and leads to unnecessarily high concentrations. The optimum disinfectant concentration is at least about 2 ppm disinfectant in the toilet bowl while unmetered systems may produce concentrations as high as 10 ppm or greater after prolonged quiescence.

Because of the potential contamination of bowl surfaces and the tendency to form aerosols at the time of flushing, it is desirable that the initial charge of water from the tank into the bowl contain disinfectant. Since much of the disinfectant found in a bowl, immediately after a flush is completed, comes from the dispenser as distinguished from being stored in the tank, it can be appreciated that the disinfectant concentration in the tank must be maintained at an "effective disinfecting" level even over prolonged periods of non-use. Failure to do so results in the aerosols formed during the early stage of a flush becoming contaminated rather than being treated with disinfectant.

The metered disinfecting dispensers described in U.S. Pat. Nos. 4,171,546; 4,200,606; 4,208,747; and 4,216,027, are designed to overcome the problems associated with long periods of non-use. These systems generally use an air bubble to isolate the disinfectant in the dispenser from the tank during quiescent periods. However, this bubble isolation arrangement does not compensate for the disinfectant concentration in the tank being dissipated during such non-use and affords no opportunity for restoring at least, in part, the desired disinfectant activity. Thus, with these dispensers there is a possibility that the first aerosols generated during the initial flush after prolonged quiescense will not be treated with an effective amount of disinfectant.

In addition, most devices described to date fail to provide means for responding to various contaminants in the tank and/or the toilet water. This results in interference with and/or scavenging of the disinfectant by such contaminants.

SUMMARY OF THE INVENTION

The present invention relates to a method and apparatus for efficiently disinfecting a flush tank and a bowl with a disinfecting agent each time a toilet is flushed. In a preferred embodiment of the invention, a persistent color is provided to the bowl when the disinfectant agent falls below a disinfecting level. In another embodiment, means are provided for responding to the contaminants found in the tank and/or water which tend to interfere with disinfectant activity.

Specifically, the present invention provides a method and apparatus for disinfecting a toilet tank by treating the water discharged from the toilet tank each time the toilet is flushed. A passive dosing dispenser that automatically dispenses a disinfecting amount of a substance with each flush is provided in the tank to carry out the cleansing and disinfecting method. The dispenser comprises a series of chambers in fluid communication including a reservoir containing a source of disinfectant, a vented volume control chamber, and a delivery tube provided with a dispensing orifice. The delivery tube orifice is in dynamic fluid communication with liquid in the toilet tank and the delivery tube also includes a vented standpipe which eliminates air locks in the system. The location of the dispensing orifice can be varied along the delivery tube depending on the level of minerals and other substances in the bowl water that tend to tie up or react with the disinfectant. Thus, the disinfectant and cleaning agent concentration is increased when such levels are high thereby insuring an effective amount of disinfectant and cleaning agent being present.

It is preferred that certain ratios be maintained throughout the system. Specifically, the ratio of the volume of the reservoir to the volume of the dose dispensed is maintained between 5:1 and 50:1; the ratio of the volume of the reservoir to the volume of actives initially present is between 2:1 and 20:1; the ratio of the volume of the dose to the volume of the delivery tube is between 1.5:1 and 5:1; and the ratio of disinfectant concentration in the reservoir to that in the volume control chamber after 100 flushes is from between about 2:1 and about 5:1.

The arrangement of chambers is such that the concentration of the aqueous disinfectant solution discharged remains substantially constant upon repetitive flushing until the chemicals utilized are depleted. The system is further characterized by means for automatically providing a color signal as soon as the chemicals are reduced below an efficacious cleaning and disinfecting level so that the user will know that it is time to change the dispenser.

It is preferred that an orificed chamber independent of the other chambers be provided for dispensing an amount of a desired substance during the initial flushes. Such substance may comprise an ingredient for cleaning tank walls. Alternately, an additional amount of chlorine is a possibility for providing heavy initial doses where required. In addition, the substance may comprise a sequestering substance which will operate to purge those toilet tanks containing certain metals that react with the disinfectant and scavenge it from the water thereby reducing the disinfecting potential during the initial flushes.

DESCRIPTION OF THE PREFERRED EMBODIMENT

Figure 1:
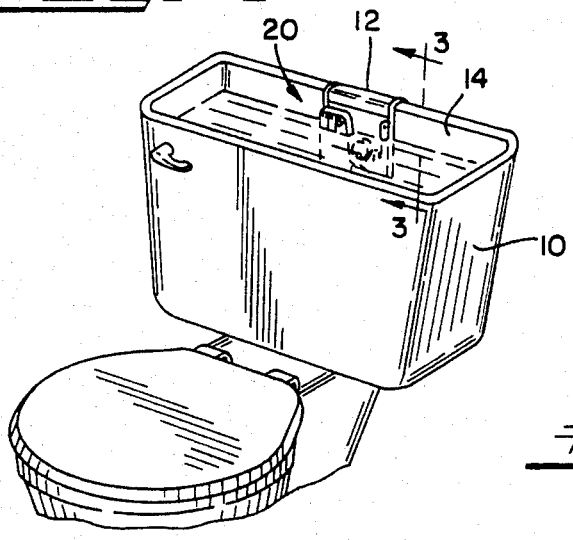
FIG. 1 is a fragmentary perspective view showing the dispenser of this invention associated with a toilet tank.
Figure 3:
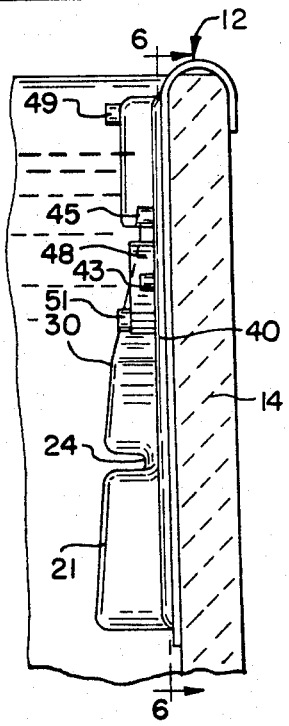
FIG. 3 is a fragmentary vertical sectional view taken about the line 3—3 of FIG. 1.
Figure 2:
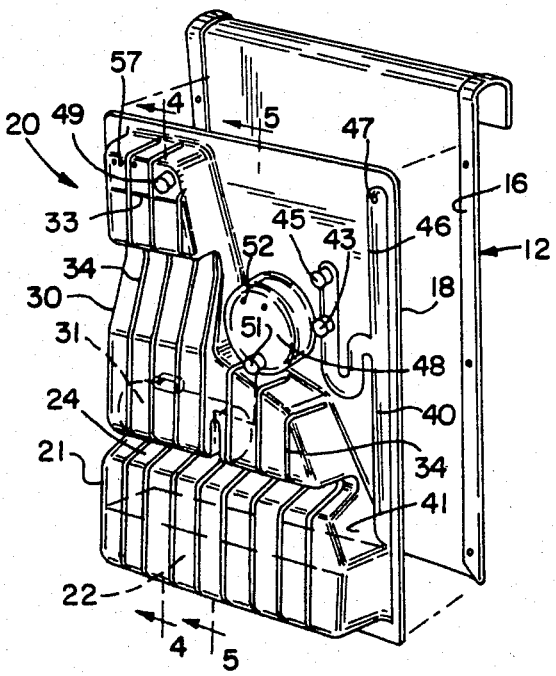
FIG. 2 is a perspective view of a dispenser characterized by the features of the present invention.

FIGS. 1 and 2 illustrate a dispenser 20 of the type contemplated by this invention associated with a toilet tank 10. In the embodiment shown, a hanger 12 is employed for suspending the dispenser on the back wall 14 of the tank. As best shown in FIG. 2, the hanger defines overturned side edges 16 which form channels adapted to receive the side edges 18 of the dispenser. The dispenser slides relative to the hanger and frictional engagement between the respective edges enable a homeowner to select the relative positions of the dispenser and hanger during use to accommodate particular conditions.

Figure 16:
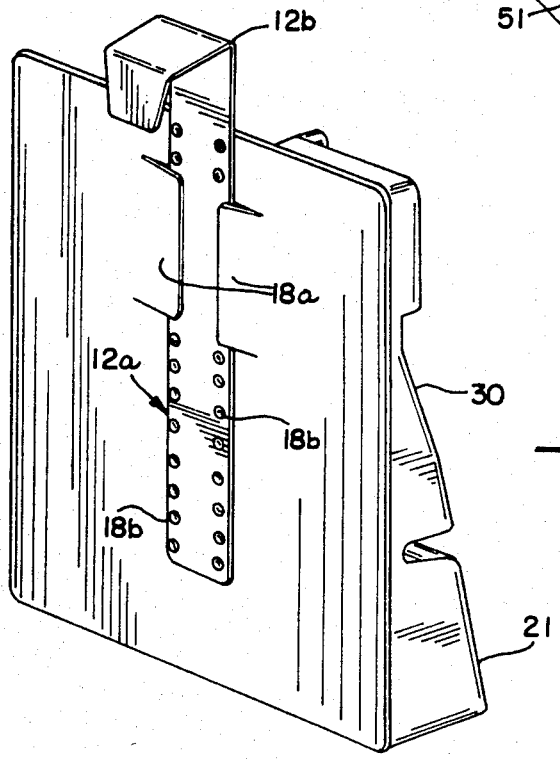
FIG. 16 is a rear perspective view of the device illustrating an alternative form of hanger means usable in the combination; and, FIG. 17 is a fragmentary view of the alternative hanger means in position for packaging.
Figure 17:
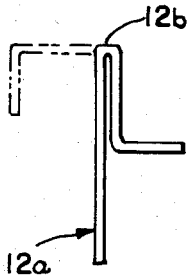

FIGS. 16 and 17 illustrate an alternative hanger arrangement wherein hanger **12*a* is held by lugs 18*a* formed on the back of the assembly. Frictional engagement is provided by raised dimples 18*b* provided along the edges of hanger 12*a* which allows the homeowner to select an operating position in the toilet tank. The hanger has a living hinge 12*b* and locking assembly which allows the portion of the hanger which protrudes to the rear and engages the toilet tank edge in normal use to be folded forward (as shown in FIG. 17**) out of the way, for packaging and storage.

It will be appreciated that other means could be provided for placing the dispenser in a tank to achieve the purposes of the invention. Bottom supports comprising legs or a shelf structure comprise some alternative possibilities.

Figure 15:
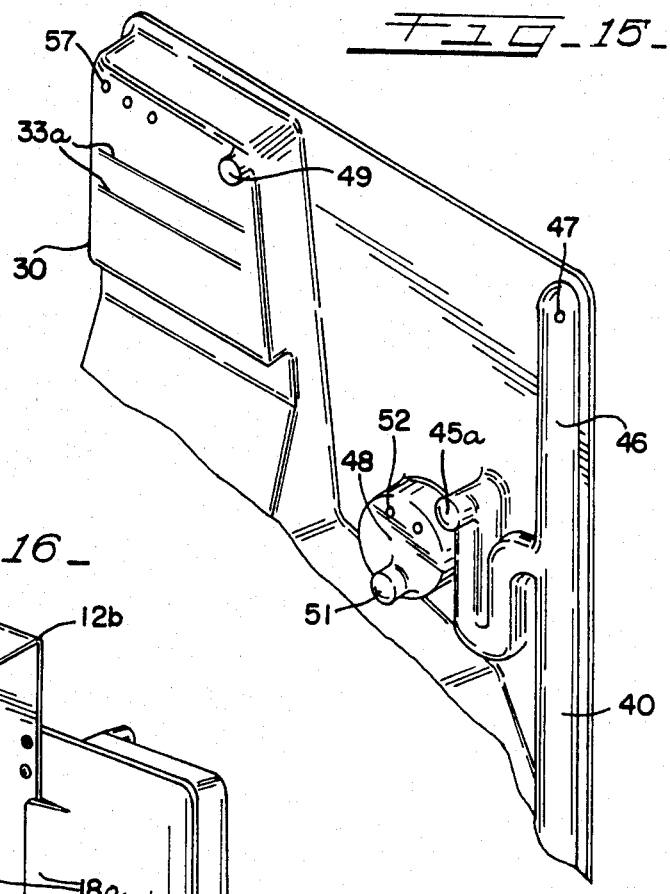
FIG. 15 is a fragmentary perspective view illustrating an alternative form of the invention.

The dispensing apparatus is positioned in the toilet tank to a level that coincides with water level indicator mark 33 provided on the front wall of the dispenser (or the form of the invention shown in FIG. 15, to be described, may be employed.) The apparatus comprises three chambers, including a reservoir chamber 21 which contains solid disinfectant 22. A baffle means 24 defines the top of the reservoir chamber and assists in maintaining a desired disinfectant concentration gradient as will be discussed below.

A volume control chamber 30 is in fluid communication with chamber 21 and a solid color signal ingredient 31 is positioned immediately above baffle 24 in chamber 30. The chamber 30 is also provided with air vent means 49 and the aforementioned water level line 33.

A delivery tube 40 is in fluid communication with reservoir chamber 21. The tube communicates with this chamber through narrow passage 41 which is located at the end of diagonal surface 25 extending from baffle means 24. This extension of the baffle means prevents short circuiting of fresh water from volume control chamber to the delivery tube 40.

A conduit 42 extends outwardly from one side of the tube 40, and the conduit includes an upwardly extending portion 44. An opening is adapted to be formed at either 43 or 45 in this extension 44 to provide access to the toilet tank water. These openings in combination with water level line 33 cooperate to make the dispenser responsive to the contaminants present in the tank and bowl and to maintain the disinfectant at an effective level. A chamber 48 is also provided and, as will be explained, the ingredients in this chamber may also cooperate in achieving this function.

As best shown in FIG. 2, the openings 43 and 45 are initially closed simply because the plastic molding operation preferably used in the manufacture of the invention leaves a plastic cap or film over these openings. The user of the construction then has the option of clipping off one or the other of these caps. It has been found that with a high staining potential, the lower cap 43 is preferably clipped off to thereby increase the dosage on a given flush and maintain the disinfectant at an effective level. A lesser dosage is achieved by using the higher opening shown at 45.

The delivery tube 40 also includes a standpipe portion 46. The upper end of this standpipe defines an air vent opening 47 which could be left open during manufacturing or which could also be opened as part of the instructions to the user. As will be explained in greater detail, the standpipe and associated air vent insure continuous operation of the apparatus free from any air lock.

A third chamber 48 may also be utilized in the practice of the invention to assist in maintaining the disinfectant at effective levels. This chamber 48 which is independent of the other chambers and which may, for example, house a sequestering or chelating agent 50 adapted to be dispensed through opening 51 defined by the chamber 48. Substantially all of the sequestering substance is dispensed during the initial flushes of the dispenser and independent of the flushes. This feature of the invention is particularly useful where water with high metal ion concentrations is encountered or where the tank has substantial metal ion build-up in the form of scum and deposits that collect in some tanks. The opening 51 is preferably covered by a cap or film in the course of the manufacturing operation so that the contents of chamber 48 can be selectively used. For example, where a household has an independent water treatment capability, the user may choose not to add additional chemicals to the toilet tank water. It is also contemplated that the user could simply add chemical agents of various types independently of the device of the invention.

The chamber 48 is preferably provided with vent holes 52 which may simply be pinhole openings automatically produced during manufacture or provided by the user. This insures free circulation of water in the chamber 48, and since the chemical 50 is present in a relatively small amount, it will tend to be dispensed rather quickly. Thus, although chamber 48 is not part of a closely controlled dosing operation, it is part of the dispenser that is responsive to the conditions in the tank to assist in maintaining the disinfectant at an effective level.

Each of the chambers 21 and 30 defines ribs 34 which serve to rigidify the chamber walls. In addition, legs 35 are molded in the construction in the area of baffle means 24 to minimize any tendency for the outer walls of chambers 21 and 30 to move inwardly toward the back wall of the construction.

The combination of ribs 34 and legs 35 is useful to avoid deviation in operating cycles which could occur due to "pulsation" of the chamber walls as water levels and consequently hydrostatic pressures change during the operation. Such pulsations would change the volume of the respective chambers which would in turn affect the dosage.

The operation of the construction generally relies on the structural characteristics of the chambers 21 and 30 in association with the tube 40. The physical character of the ingredients in the respective chambers is less critical to the operation; however, it is preferred that these ingredients be provided in cake or pellet form. Concerning the color signal ingredient 31, it will be noted that this is depicted as a cylinder which is confined within the chamber 30 by means of lugs 53 and 54. These lugs serve to confine the cylinder against movement during handling, etc., which could lead to disintegration. It will be appreciated that individual pellets could make up the ingredient 31, or an ingredient in powder or liquid form confined within a dispenser which itself had an orifice communicating with the chamber 30 could also be provided.

The pellet form of the disinfectant may comprise a tablet about one inch in diameter and one-half inch thick. The coloring agent may comprise spheres of about one-half inch in diameter. The sequestering or other agent in chamber 48 may take either of these forms or other convenient forms.

The physical character of the disinfectant 22 in chamber 21 can, of course, vary in other ways from the block of solid material shown in the drawings. It is merely sufficient that the physical character be such that exposure to the water will result in a desired concentration of chemicals in solution in the course of the operating life of the construction. Such concentrations can obviously be varied widely, and do not specifically form a part of this invention. Guidelines for the many variations which could be used with the structure of this invention are found in the foregoing description including the reference material set forth therein.

Concerning the physical character of the chambers and standpipe, it has been determined that various ratios should be considered to provide optimum operation. Concerning the chamber 21, the volume of the chamber relative to the initial volume of disinfectant 22 should be in a ratio from 2:1 to 20:1, while the volume of this chamber relative to volume of dose dispensed should be in a ratio between 5:1 and 50:1.

As will be more fully explained, a dose delivered to the toilet tank on a given flush will have a volume in the ratio between 1.5:1 and 5:1 relative to the volume of the delivery tube 40, including conduit 42, extension 44, and standpipe portion 46. Finally, after 100 flushes, the ratio of disinfectant concentration in the reservoir chamber 21 to that in the volume control chamber 30 will be from between about 2:1 to 5:1.

In the specific operation of the construction, the user will provide certain openings necessary for operation while other openings are preferably already present. For example, one or more pinhole openings 47 are provided for standpipe 46. In addition, the user must select one of the openings 45 and 43 as explained above. Furthermore, openings 49 and 51 are provided for chambers 30 and 48, respectively, which the consumer opens. It is noted that pinhole air vent openings 57 and 52, respectively, are also present. As to pinhole vent 52, it is necessary to provide means for the intake and expelling of air from the chamber 48. As to pinhole vent 57, it is desirable to provide vent means in chamber 30 during storage.

The construction is then hung in the toilet tank by means of the hanger 12. As noted, the construction is frictionally gripped by the hanger so that it can be manipulated to locate the mark 33 at the normal water level of the toilet tank.

Alternatively, the device of the invention can be provided with multiple water lines 33 and 33A as shown in FIG. 15 with the delivery tube 40 being provided with a single dispensing orifice 45A. In this embodiment, the alternative alignment of the specific water line with the tank water level will control the volume of disinfectant discharged and provides an alternative means for assuring an effective concentration of disinfectant with each flush.

Upon immersion, water will flow into the construction through the selected opening 43, 45 or **45*a* and into opening 51, and thereby fill the device. This will result in essentially fresh water throughout the device since there will not be a significant dissolution of the chemicals during this time. Air will, of course, be expelled through the vent openings such as 47, 49 and 52** during this initial fill, and this will result in the water in the construction seeking the same level as the water in the tank.

As the structure remains in place, a significant amount of the disinfectant will pass into solution creating a highly concentrated solution in the area 60 of the chamber 21. In view of the baffle provided at 24, and because this solution will have a higher specific gravity than the fresh water, the solution will tend to stay in the area 60. Furthermore, the relatively small passage 41 which communicates the area 60 with tube 40 avoids passage of any significant amounts of the concentrated solution into the tube 40. There will, of course, be some diffusion into the chamber 30 and tube 40; however, this is kept to a minimum by the desired structure. To the extent that there is any gas evolution as the disinfectant goes into solution, the described vents will avoid any pressure build-up within the construction.

Figure 7:
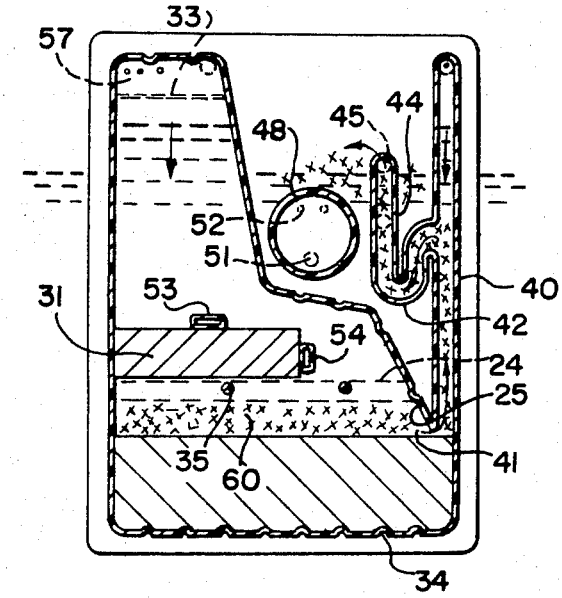
Figure 8:
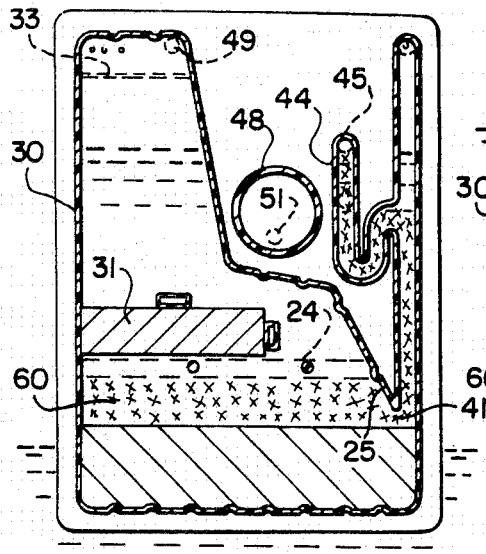

When the toilet is flushed, the level of the water in the toilet tank will fall as shown in FIG. 7. Assuming that the portion 44 of the tube 40 is opened at 45, the pressure differential will result in the dispensing of solution from pipe 40 into the tank as the water level drops. This dispensing action will continue until the liquid in volume control chamber 30 reaches the level of the opening 45 (FIG. 8). At this point, there will be equilibrium within the construction, and the dispensing action will cease even as the tank water level drops to its lowest level. Because the water drawn into tube 40 and dispensed through opening 45 will be water removed from the area 60 of chamber 21, a solution having a high concentration of disinfectant will enter the toilet tank. When opening 43 is used, a larger volume of disinfectant is dispensed in order to compensate for the minerals and other contaminants present in certain types of water which tend to interfere with the disinfectant activity.

As the water level drops in chamber 30 and tube 40 to the level of opening 45, air is drawn into the chamber and tube through the vents provided therein. This insures that there is no air lock in any part of the system.

As indicated, the dispensing of the concentrated solution takes place early in the flush cycle, that is, the dispensing stops before the liquid level in the tank has dropped to its lowest level. This results in effective amounts of disinfecting agent being delivered to the toilet bowl as the water in the tank moves from the tank to the toilet bowl. As previously explained, and as will be apparent when considering the disclosed structure, the volumetric amount of concentrated solution delivered at any given time can be readily controlled by the sizes of the chamber 30 and tube 40, the location of the dispensing openings, and the position of the construction in the tank.

Figure 6:
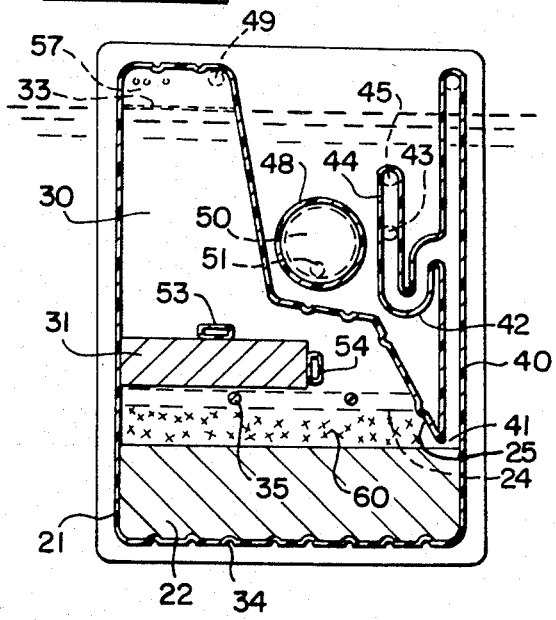
FIGS. 6–11 are sequential sectional views taken about the line 6—6 of FIG. 3 showing the dispenser at various times during the normal flush cycle and/or life of the apparatus.
Figure 4:
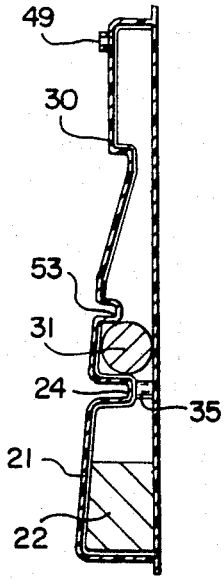
FIG. 4 is a vertical sectional view taken about the line 4—4 of FIG. 2.
Figure 9:
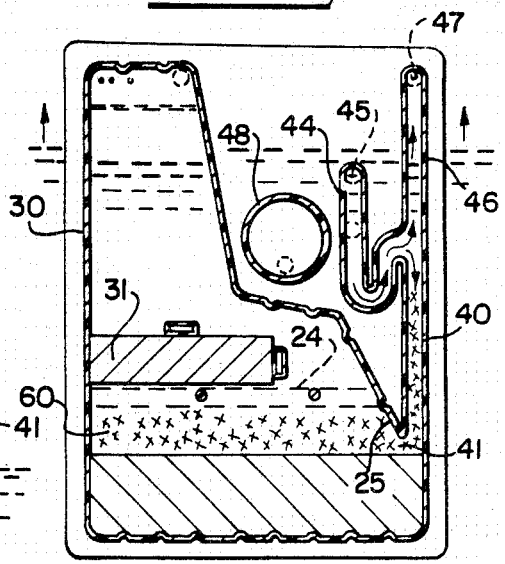

In the next stage of the operation, the water level in the tank rises as shown in FIG. 9 back to the quiescent state as shown in FIG. 6. As this tank water rises, water will enter through opening 45 to return the level within the construction to the equilibrium condition shown in FIG. 6. This will result in movement of the solution of highest concentration back into the area 60 of the chamber 21 to prepare the apparatus for the next flushing cycle. This feature is particularly advantageous if the construction goes through any relatively long period of non-use. As previously noted, the size of the passage 41 between the area 60 and tube 40 is relatively small and no significant amount of diffusion of disinfectant will occur. Accordingly, the water in the tube 40 and particularly in the portion 44 of the tube will have little, if any, disinfectant for transfer to the tank water during the normal flushing schedule. No significant amount of the disinfectant will be lost so that the life of the product will be primarily dependent on the number of flushes rather than on the period within which it is present in a toilet tank. As will be explained, however, over a long quiescent period, disinfectant will be gradually discharged through a diffusion process to maintain appropriate conditions.

Figure 10:
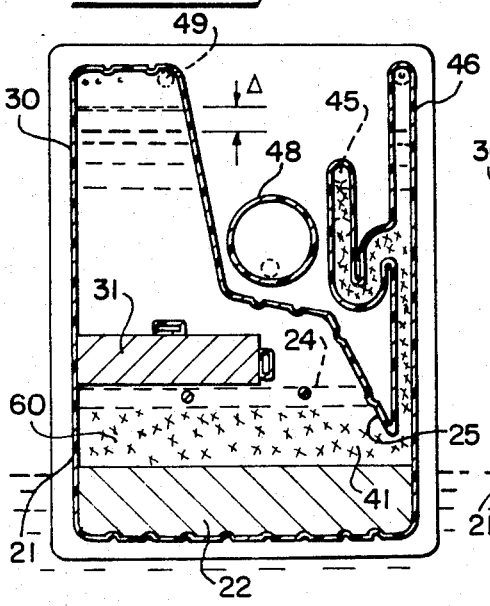

FIG. 10 illustrates the condition of the structure after a flush and with a substantial amount of solid disinfectant remaining in the chamber 21. In particular, a self-compensating aspect of the construction is illustrated, this self-compensating aspect being dependent upon the concentration of the disinfecting agent in the area 60 of the chamber 21. FIG. 10 illustrates the condition where the solution in the area 60 and in the tube 40 is highly concentrated. As explained, significant amounts of the disinfectant do not enter into chamber 30 so that a unit volume of solution in chamber 30 is lighter than a unit volume in tube 40.

When the water level in the tank is at its lowest level as shown in FIG. 10, the level of the water in chamber 30 will also be at its lowest point which is above the level of the opening 45. This results because of the heavier solution in the tube 40. Accordingly, a volume of concentrated solution represented by the symbol Δ will be dispensed through the opening 45 on a given flush.

Figure 11:
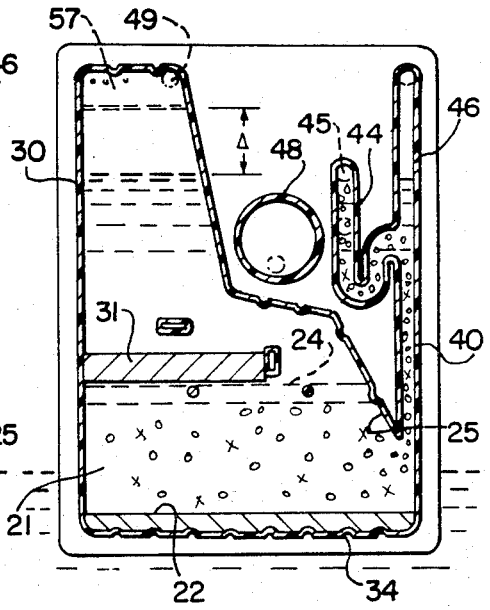

When the amount of disinfectant 22 has been reduced to a level such as shown in FIG. 11, the solution in the area 60 will be more dilute and not as heavy. Therefore, the volume of the dosage on a given flush, Δ, is greater since the weight differential between the solution in the chamber 30 and the solution in tube 40 is less pronounced. The result of the operation discussed with respect to FIGS. 10 and 11 is that the amount of disinfectant delivered to the toilet tank will remain substantially constant event when the available disinfectant 22 is so small that very low concentration dosages are dispensed. Thus, when a low concentration solution develops in the system, the amount of dosage will automatically increase.

It will be appreciated that when the available disinfectant is completely dissipated, the maximum dosage is achieved; however, in that instance, little or no disinfectant will enter the toilet tank. Provision is made in the construction of this invention to alert the user to the fact that significant amounts of disinfectant are no longer being delivered. This will, of course, lead to removal of the construction and replacement with a fresh construction.

The color signal ingredient 31 is provided to indicate when a suitable amount of disinfectant is no longer being dispensed. It will be apparent when considering the operation of this invention that the color signal ingredient, being exposed to water in the chamber 30, will be regularly depleted as water moves from chamber 30 into chamber 21 to replace solution during each cycle of operation. It is known, however, that the calcium hypochlorite comprising the disinfectant 22 will bleach the color from the ingredient 31 so that no significant color will appear in the dosages dispensed to the toilet tank. After the disinfectant 22 is significantly depleted, however, the bleaching effect thereof will no longer be available, and the color ingredient will thereafter color the tank water and pass to the bowl whenever the toilet is flushed. When the user sees this color in the toilet bowl, it will be obvious that a new construction of the invention must be substituted.

It will be apparent that instead of changing from no color to a color, one could select ingredients for cake 31 which would be of one color when mixed with the disinfectant solution and another color when the disinfectant had been depleted. In either event, the user will be alerted to the lack of disinfectant.

In the selection of ingredients for the color control agent and disinfectant, it is likely that certain inert materials will be included in the cakes or pellets employed. The construction of this invention provides a suitable means for insuring that these inert ingredients will not adversely effect the operation of the construction. To the extent that the ingredients are lighter than water, they will simply float to the top of chamber 30 and tube 40. Otherwise, the ingredients will drop to the bottom of chamber 21, but in any event, these inert ingredients will not be in a position to clog passages or otherwise disrupt operations.

Figure 12:
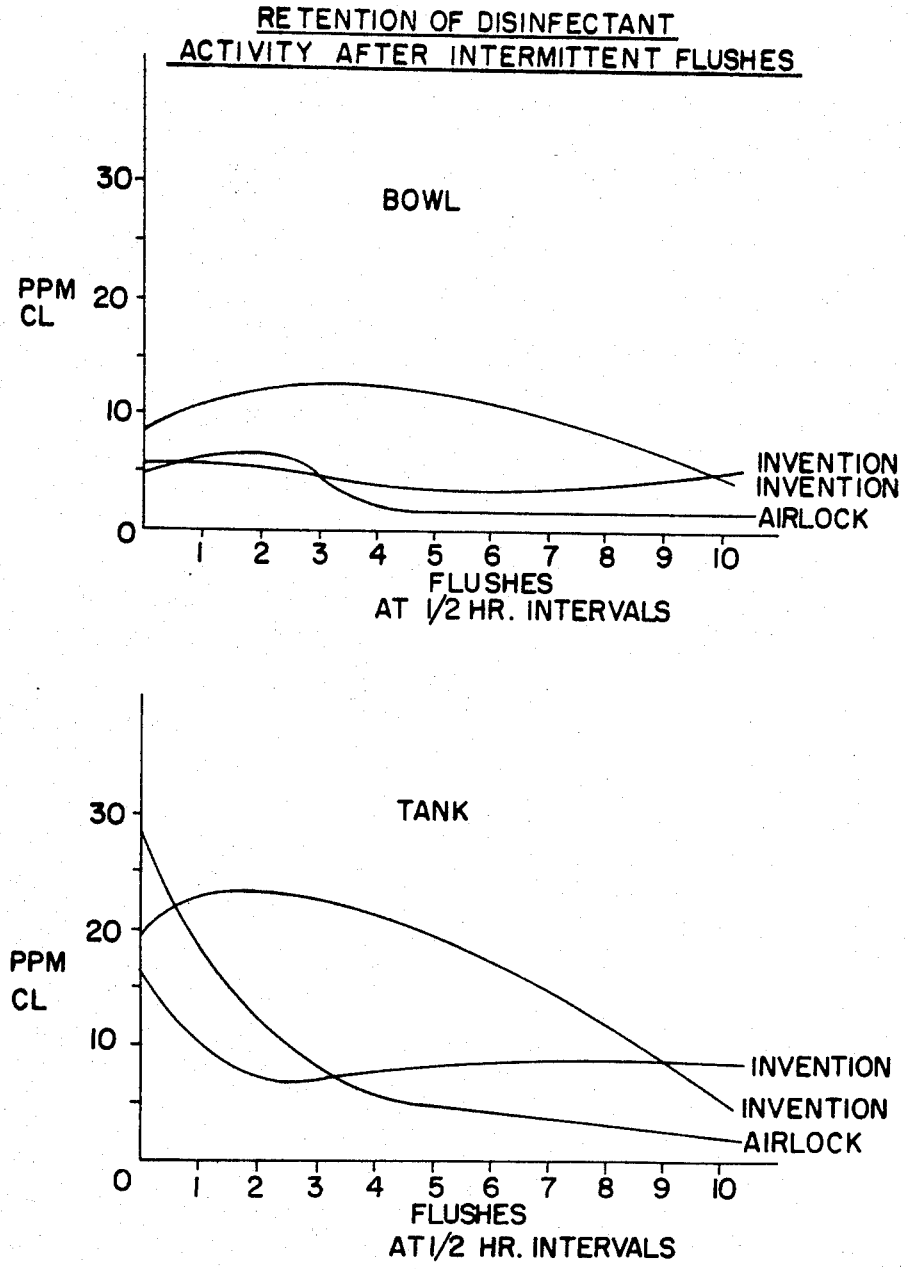
FIG. 12 provides graphical comparisons of bowl and tank retention of disinfectant activity after intermittent flushes.
Figure 13:
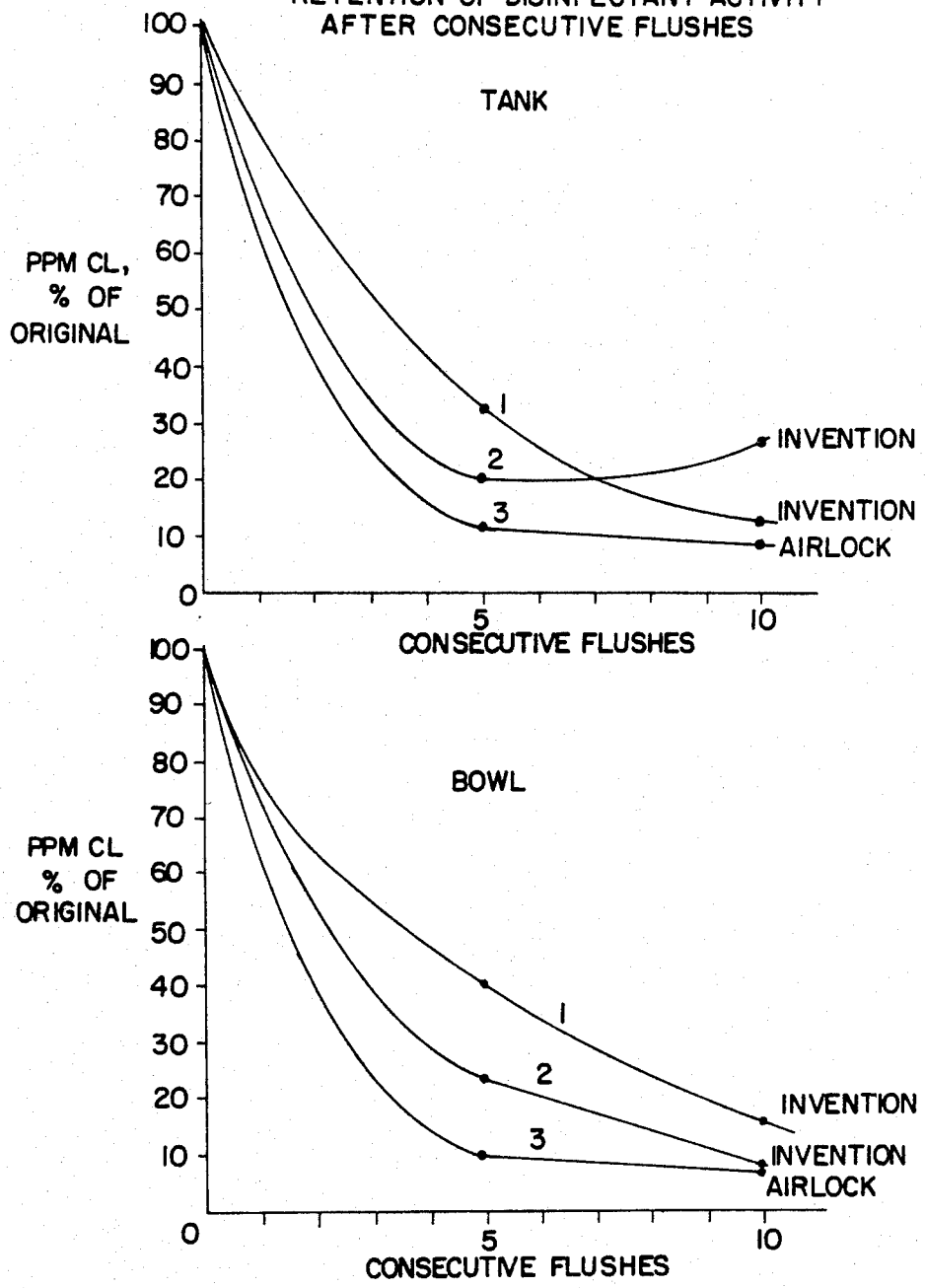
FIG. 13 provides graphical comparisons of bowl and tank retention of disinfectant activity after consecutive flushes.

As indicated, the ratio of volume of reservoir 21 to the volume flow through delivery tube 40 may be as high as 100:1 but preferably is below about 25:1. Suitable constructions control this ratio between about 8:1 and 12:1. This ratio is important for obtaining the retention of disinfecting properties after repeated consecutive flushes and intermittent flushes as shown in FIGS. 12 and 13. Although not critical, the volume ratio of the reservoir to the volume control chamber 30 is preferably maintained between 1:4 and 10:1.

In FIG. 12, standard iodometric titrations were used to establish chlorine concentrations. The procedure used was to flush the toilet, draw samples from the bowl and tank, and analyze immediately. This was repeated at ½ hour intervals. In FIG. 13 the same procedure was followed except the consecutive flushes were analyzed in increments of 5. This ratio of chamber 21 to volume of dose is also responsible for the consistent dispensing properties over time and the surprising low deviation from the mean dispensing concentration shown in FIG. 14.

In this instance, the mean flush level is obtained by flushing a number of times per day. The chlorine analysis is done at least once per day and the results of each chlorine analysis were multiplied by the number of flushes since the previous analysis. These products were totalled and divided by the total flushes to yield the mean.

For the purposes of the present invention, a disinfectant is defined as a substance which either kills or controls the growth of bacteria and certain viruses commonly found on the water-flushed surfaces of a toilet bowl, and/or in the water of said bowl, and/or in the aerosols generated on flushing of a contaminated toilet bowl. Any suitable disinfectant agent which yields active chlorine or active oxygen in aqueous solution can be employed to advantage in the practice of the present invention, particularly materials used as bleaching agents.

A highly preferred bleaching disinfecting agent is one which yields a hypochlorite species in aqueous solution, the hypochlorite ion being chemically represented by the formula OCl. The hypochlorite ion is a strong oxidizing agent and, for this reason, materials which yield this species are considered to be powerful disinfecting agents.

Those disinfecting agents which yield a hypochlorite species in aqueous solution include alkali metal and alkaline earth metal hypochlorites, hypochlorite addition products, chloramines, chlorimines, chloramides, and chlorimides. Specific examples of compounds of this type include lithium hypochlorite, calcium hypochlorite, calcium hypochlorite dihydrate, monobasic calcium hypochlorite, dibasic magnesium hypochlorite, chlorinated trisodium phosphate dodecahydrate, potassium dichloroisocyanurate, trichlorocyanuric acid, sodium dichloroisocyanurate, sodium dichloroisocyanurate dihydrate, 1,3-dichloro-5.5-dimethylhydantoin, N-chlorosulfamide, Chloramine T, Dichlormaine T., Chloramine B and Dichloramine B.

Examples of disinfecting agents which yield active oxygen in aqueous solution are sodium perborate and potassium monopersulfate ($KHSO_5$).

Although there are circumstances where the use of such disinfecting agents in a loose granule form may be advantageous, generally, it is preferable to compress the disinfectant agents into a tablet or cake with the use of equipment such as tableting presses, extruders, etc. Such compaction helps to regulate the solubility of the disinfecting agents while allowing for a more efficient use of space in relation to the size and fit of a construction into the toilet tank of a flushing toilet.

Disinfecting agents of the type described above may comprise from about 10% to about 100% of the disinfecting formula by weight when utilized in conjunction with the practice of the present invention.

For disinfectant compositions suited for use in the practice of the present invention, disinfectant agent stabilization is generally achieved by careful selection of disinfecting agents and noninterfering inorganic filler salts. For solid systems containing bleach, it is generally suitable to include a stabilizer for the bleaching agents. For some types of bleaching agents, particularly oxygen bleaching agents, this material can be a water-soluble bleach stabilizing agent selected from the group consisting of alkali metal, alkaline earth material, ammonium and substituted ammonium salts of an acid having an ionization constant at 25° C., for the first hydrogen, of at least about $1\times10^{-3}$. Stabilizing salts include the alkali metals, alkaline earth metals, ammonium, and substituted ammonium sulfates, bisulfates, nitrates, silicates, chlorides, phosphates, pyrophosphates, polyphosphates and hexametaphosphates. Specific examples of such materials include magnesium sulfate, sodium sulfate, potassium sulfate, ammonium sulfate, lithium sulfate, dimethylammonium sulfate, sodium chloride, lithium chloride, potassium chloride, sodium bisulfate, potassium bisulfate, ammonium bisulfate, sodium nitrate, magnesium nitrate, calcium nitrate, sodium tripolyphosphate, trisodium phosphate, sodium metaphosphate, sodium hexametaphosphate, potassium pyrophosphate, sodium tetraphosphate, sodium silicate, and sodium metasilicate. Stabilizing agents of this type are described more fully in U.S. Pat. No. 3,639,285 issued to Niesen.

For chlorine bleaching agents, particularly N-chloroimides, a highly preferred stabilizing agent is sodium acetate. Use of this material as a bleach stabilizer is described more fully in U.S. Pat. No. 3,829,385 issued to Abbot, et al. In solid compositions suitable for use in the practice of the present invention, such disinfectant stabilizing agents are preferably utilized to the extent of from about 1% to about 90% by weight of the composition.

It is noteworthy that preferred disinfectant containing tablets employed in practicing the present invention have a specific dissolution characteristic. In particular, disinfectant tablets suitable for use in practicing the present invention, when submerged in water, release active ingredients to form an aqueous solution of the disinfectant and soluble inorganic filler/stabilizing salts. Such solubilization results in the formation of a concentration gradient having greatest strength at the bottom of the solution and lowest strength at the surface of the solution. In addition, insoluble salts formed by ion exchange with materials contained in the particular disinfectant particles which tend to break off from the tablet as it dissolves, tend to settle to the bottom of the solution at the base of the reservoir.

As set forth, a color signal ingredient 31 is included in the apparatus. This signal is designed such that when the concentration of the disinfecting agent falls below an effective level, the color signal carries over to the toilet bowl and, thereby, announces to the user of the apparatus that the apparatus should be replaced.

Various disinfectant responsive dye systems can be used either alone or in combination with various coating materials. The net effect of these dye systems is that they are present at a level sufficient to color the flush water when the concentration of the disinfecting agent in the apparatus falls below the range required to deliver an effective quantity of disinfecting agent.

The dye system should be soluble in the disinfectant solution dispensed to the extent of at least 0.01% by weight at 25° C. It should also be sufficiently responsive to the disinfecting agent present so that it is oxidized to a colorless state until the disinfecting agent concentration falls below the range necessary to deliver an effective amount of disinfecting agent to the flush water. At this concentration range, the dye will not be oxidized by the disinfecting agent and will produce a color in the toilet bowl. Among the dyes which have been found satisfactory for use in the present invention are FD and C Green, No. 3, and Intracid Pure Blue V extra concentrate.

The amount of dye dispensed to the toilet, in the process of the invention, will depend on the type of dye, its susceptibility to attack by the disinfectant agent, other materials formulated with the dye, the method used to pelletize the dye, and the location of the dye system in the apparatus. Generally, the amount of dye dispensed will vary over the life of the apparatus. That is, at the outset, the amount of dye dispensed into the toilet is reduced because the dye system is protected from the disinfectant solution by the other ingredients present, the compactness of the dye system pellet and the location of the dye system in the apparatus.

In a preferred embodiment of the invention, the dye system comprises a pellet containing the dye in a concentration from between about 5 and about 20% by weight, a solution control agent such as sodium stearate in a concentration from between 5 and about 40% by weight, and the balance comprising a soluble carrier, such as sodium chloride. Said pellet may be coated with a material of very low solubility, such as shellac. In a particularly preferred embodiment, the dye system comprises a pellet containing 10% Intracid Pure Blue V extra concentrated, 20% sodium stearate and 70% sodium chloride coated with 3-pound cut orange shellac.

In a particularly preferred embodiment of the invention, the dye system is located immediately above the baffle means 24 separating the volume control chamber 30 from the reservoir 21. The concentration gradient of the disinfecting solution between the reservoir and immediately above the baffle means and the slow flow of fluid through and past the area, is ideal for controlling the rate of solution of the dye system, and the dye is drawn through the disinfecting bleach before exiting to the toilet tank.

The disinfectant concentration in the solution around the dye system, located at the base of the volume control chamber, remains substantially constant until the disinfectant concentration in the reservoir is reduced substantially. Generally, the ratio of the disinfectant concentration in the reservoir, to that in the volume control chamber, is from about 5:1 to about 2:1, until the disinfectant approaches exhaustion. This concentration gradient is employed in formulating the dye system formulation.

When the disinfectant concentration just about the baffle means 24 drops to the concentration range of from between about 0.1 and about 3% disinfectant, the dye system begins to color the contents of the apparatus. That is, the disinfectant solution in the apparatus is gradually colored by the dye-starting at the base of the volume control chamber and proceeding to the reservoir and finally into the delivery tube. There is usually sufficient dye present to dispense at least 10 or more flushes of colored disinfectant solution before the dye is exhausted.

Optionally, the dyes used in the present invention can be formulated into compositions containing ingredients other than those described above, which ingredients it is desired to dispense into the toilet bowl, such as, for example, pH control agents, other surfactants, sequestering agents, perfumes, and inorganic salts such as sodium sulfate and sodium acetate. Surfactants can provide enhanced sanitizing performance through breakup and emulsification of soils, and also provide some sudsing in the toilet bowl, which may be aesthetically desirable. Perfumes provide a pleasant smell to the area surrounding the toilet and also help to obscure the "bleach" smell of the disinfecting agent. Suquestrants aid soil removal by sequestration of multivalent metal ions.

When the dyes are formulated with surfactants, the resulting compositions will generally comprise from about 5% to about 99% surfactants and from about 0.2% to about 15% dye. Perfumes will normally be used at levels of up to about 25%, and inert diluents at levels up to about 90%. Sequestering agents such as potassium pyrophosphate, sodium tripolyphosphate, or ethylenediamine tetraacetate can be used at levels up to about 25%. Potassium pyrophosphate and sodium tripolyphosphate are examples of sequestering agents which are also alkaline, and, therefore, may function as pH control agents in the present invention.

Compositions comprising the dye and a surfactant and/or other ingredients can be conveniently pressed into the form of a tablet, pellet or cake of solid material. Such tablets, pellets or cakes can be made by extrusion or hydraulic stamping, or by pouring a melt of the composition into a mold and solidifying the composition by cooling.

For the purposes of the present invention, it is understood that the term "passive dosing dispenser" means a construction with no moving parts and wherein the flow of toilet liquid into the dispenser and the flow of disinfecting solution out of the dispenser is obtained in the absence of flow interruptors, such as air locks. In a preferred embodiment, the passive dosing dispenser is provided with multiple air vents, in order to avoid the formation of air locks in the various chambers. It is this uninterrupted flow that is credited with the unexpected disinfecting performance upon repetitive flushing and during quiescence.

The chambers of the construction are in fluid communication with each other, however, only the delivery tube 40 is in dynamic fluid communication with the water in the toilet tank. It is critical to the disinfecting performance of the present invention that during quiescent periods the dispensing orifice (43 or 45) of the delivery tube be in a dynamic fluid state with the toilet tank water, as distinguished from a static "air lock" system. In this dynamic fluid state, some of the disinfectant present in the delivery tube will diffuse through the dispensing orifice into the toilet tank. This controlled diffusion of disinfectant is deemed critical to the ongoing disinfecting of the toilet tank surface and liquid contained, therein, such that upon flushing after prolonged quiescence, the aerosols initially generated from the incoming tank water contain sufficient disinfectant so that the disease transmission potential of these aerosols is reduced significantly. Obviously, once the dose of disinfectant is released from the dispenser into the toilet bowl, the aerosols generated will contain sufficient disinfectant to be rendered harmless. However, this condition usually occurs near the end of the flush cycle when the water in the tank is at its lowest level. Thus, there is a critical condition that can occur in a toilet using prior art devices after quiescence, that is, when the disinfectant in the bowl and tank from the previous flush has been exhausted and the aerosols that result at the beginning of the flush can be contaminated. It is here that the dynamic fluid state of the dispensing tube 40 plays a key role in controlling the disease transmission potential of the toilet.

The role of the sequestering substance in one preferred embodiment of the invention was discussed previously. The sequestering substance 50 is located in chamber 48 and dispensed from orifice 51. Chamber 48 is independent of the other chamber in the construction and once it is filled with fresh water, the sequestering substance dissolves and passes into the toilet tank through orifice 51. This rate of solution and discharge into the tank water is independent of the flow of disinfectant from the construction due to the flushing of the toilet. Thus, the sequestering substances normally would be dispensed as a surge or series of surges of chemical which are selected to act relative to certain minerals and contaminants normally found on the walls of the toilet tank. This surge tends to neutralize these contaminants and to allow the disinfectant dispensed to be maintained at an effective concentration. As already noted, chlorine, dyes and other chemicals could also be stored in chamber 48.

Table I below shows the disinfecting activity in the toilet tank over time of dispensers of the invention compared with a commercially available "air lock" dispenser. The advantage of the dynamic fluid state of the dispenser of the invention is apparent.

TABLE I

| | Toilet Tank Chlorine Concentration, ppm | |
|---|---|---|
| PRODUCT | IMMEDIATELY AFTER FLUSHING | APPROX. 60 HRS. AFTER FLUSHING |
| Air Lock | 3 | 0 |
| Air Lock | 6 | 0 |
| Invention | 8 | 2 |
| Invention | 3 | 1 |

In accordance with this invention, it is critical that only a portion of the actives present in the reservoir 21 be drawn down with any single flush, as distinguished from air lock systems where most of the concentrate is drawn down with each flush. In this manner, the dispenser of this invention is able to generally retain a higher percentage of disinfecting material in either the tank or bowl over prolonged periods of time and especially upon repetitive flushings. See Table II below. Generally, up to about 20% by volume, and preferably between about 5% and about 10% by volume, of the reservoir 21 can be drawn off in any single flush.

TABLE II

| % Retention of Original Chlorine Concentration After Repetitive Flushing At Various Time Intervals | | | | |
|---|---|---|---|---|
| No. Of Flushes | Time Interval, Hrs. | Type Of Dispenser | % Retention Tank | % Retention Bowl |
| 6 | 0.5 | air lock | 6 | 33 |
| | | air lock | 17 | 40 |
| | | invention | 58 | 119 |
| | | invention | 53 | 67 |
| | | invention | 100 | 133 |
| 5 | 1.0 | air lock | 17 | 18 |
| | | invention | 61 | 74 |
| | | invention | 100 | 100 |
| 14 | 0.5 | air lock | 25 | 12 |
| | | invention | 30 | 37 |
| | | invention | 67 | 200 |

The rate at which this volume of actives is dispensed is controlled by the cross-sectional area of the delivery tube 40. For optimum disinfecting, this rate of discharge is such that the volume to be dispensed is cleared from the dispensing orifice, before all of the water to be discharged from the toilet tank totally exits the tank. In this manner, the maximum disinfecting of the wetted bowl surface is obtained. See Table III below. For example, if an excessive amount of the actives were retained in the tank and not passed directly to the bowl, these retained actives would have little disinfecting value and, on prolonged quiescence, would dissipate from the tank producing no disinfecting effect, i.e. the germs in the bowl are the primary target of the disinfectant.

TABLE III

| Ratio Of Bowl To Tank Chlorine Concentration Immediately After Flush | | | |
|---|---|---|---|
| Type of Dispenser | Chlorine Conc. (PPM) Tank | Chlorine Conc. (PPM) Bowl | Chlorine Conc. Bowl/Tank Ratio |
| air lock | 14 | 7 | 0.5 |
| air lock | 10 | 3 | 0.3 |
| invention | 2 | 7 | 3.5 |
| invention | 2 | 8 | 4.0 |
| invention | 7 | 11 | 1.6 |
| invention | 4 | 6 | 1.5 |

Following are examples of the practice of the invention including examples based on actual tests and some others provided to illustrate the intended scope of the invention.

EXAMPLE I

The above-described passive dispensing device was charged with 62.4 g (2.2 oz.) of commercially available 65% calcium hypochlorite in the form of eight (8) briquets placed in the reservoir chamber 21. This device was installed in a standard flush toilet with the water line 33 2 cm below the top of the volume control chamber 30. This provided an approximate dosage volume of 14 cc. The toilet was flushed periodically and the contents of the toilet tank and bowl analyzed for available chlorine. Analysis was performed at varying intervals and occasionally, analysis was done just before flushing.

The analysis was accomplished iodometrically using 50 ml samples and 0.01N sodium thiosulfate as titrant, a well-known technique. Samples were taken from the geometric center of the tank and from the lower center of the bowl just ahead of the bowl outlet.

The device was in use 35 days and flushed 271 times. After the 272nd flush, the available chlorine concentration was 2 ppm in the tank and 4 ppm in the bowl. A recent downtrend in available chlorine had been observed indicating the device was near exhaustion, so it was removed from the toilet and the contents analyzed. It was determined that 96.5% of the original calcium hypochlorite had been consumed.

Over the life of the device, the average available chlorine concentration delivered per flush was 4 ppm in the tank and 8 ppm in the bowl.

EXAMPLE II

In a similar setup, a color indicator was tested as well. In this case, the construction was charged with 70.7 g of 65% calcium hypochlorite briquets in the reservoir. A 20 g dye pellet consisting of 10% FD and C Green #3, 20% sodium stearate, 70% calcium chloride dihydrate and coated once with 3 lb cut orange shellac was placed in the dye area at the base of the volume control chamber. This was installed in a standard flush toilet and the toilet operated for several days, with the available chlorine in the tank and bowl being monitored. After 28 days and 125 flushes, the average per flush available chlorine concentration in the bowl was 12 ppm. Color first appeared within the device at the 122nd flush. After the 126th flush, the available chlorine concentration in the bowl was 0 ppm and the water was tinted blue indicating the device should be changed. The blue color was permanent persisting overnight and additional flushing intensified the color.

EXAMPLE III

Figure 5:
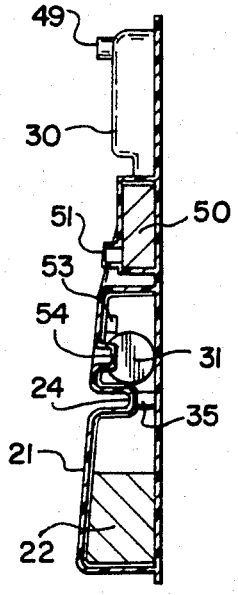
FIG. 5 is a vertical sectional view taken about the line 5—5 of FIG. 2.

In a repeat of a test similar to Example I, sodium tripolyphosphate sequestering agent in pellet form was located in a separate chamber 48 as illustrated in FIG. 5 of the drawings. This pellet was approximately 3.2 g in weight and was exhausted within 150 flushes, substantially before exhaustion of the disinfecting agent.

EXAMPLE IV

Example II was duplicated using 71.4 g. of 65% calcium hypochlorite briquets in the reservoir. An identical dye pellet, as in Example II, was used. After 51 days and 202 flushes, the available chlorine content in the bowl was 1 ppm. After the 203rd flush, the available chlorine in the bowl was 0 ppm and after the 204th flush a blue tint appeared in the bowl, indicating the device should be changed. Over the lifetime of this device the average per flush available chlorine concentration in the toilet bowl was 4 ppm.

EXAMPLE V

To test the longevity of the color signal, a device similar to the previous examples and containing a 20 g dye tablet consisting of 10% FD & C Green #3, 20% sodium stearate and 70% sodium chloride was used. This was installed in the powder room toilet of a home and subjected to a normal but unknown flushing schedule. After approximately 3½ months, the device was retrieved and replaced in a laboratory toilet, where it was subjected to an accelerated flushing schedule. Qualitative tests indicated adequate chlorine disinfectant was being delivered. Blue color appeared in the toilet bowl on the 116th day after originally being placed in service.

EXAMPLE VI

A device as described in Example IV was used in which the dye in the dye pellet composition was Intracid Pure Blue V extra concentrated. The results were essentially the same as in Example IV. Although the color occurred at a sightly later time.

EXAMPLES VII–XVI

Illustrative examples in Table 4 show the variations in form the device of the invention may take and provide a basis for estimating the retention of the disinfecting activity after several days of quiesence.

TABLE 4

ILLUSTRATIVE EXAMPLES OF DEVICES OF THE INVENTION

| EXAMPLE | DISINFECTANT | DISINFECTANT FORM | SEQUESTERING AGENT | DYE | VOL. RATIO RESERVOIR: DOSE | VOL. RATIO DOSE: DEL. TUBE | EST. DISINFECTANT CONC. AFTER 3 DAY QUIESENCE |
|---|---|---|---|---|---|---|---|
| VII | Calcium Hypochlorite | Briquet | Sodium Tripolyphosphate | Intracid Pure Blue V Extra Conc. | 15:1 | 2:1 | 2–5 ppm |
| VIII | Calcium Hypochlorite | Briquet | Sodium Tripolyphosphate | Intracid Pure Blue V Extra Conc. | 15:1 | 3:1 | 1–3 ppm |
| IX | Calcium Hypochlorite | Briquet | $Na_4EDTA$ | Intracid Pure Blue V Extra Conc. | 15:1 | 2:1 | 2–5 ppm |
| X | Calcium Hypochlorite | Briquet | $Na_3NTA$ | Intracid Pure Blue V Extra Conc. | 20:1 | 2:1 | 2–5 ppm |
| XI | Calcium Hypochlorite | Briquet | Sodium Metaphosphate | Intracid Pure Blue V Extra Conc. | 15:1 | 2:1 | 2–5 ppm |
| XII | Calcium Hypochlorite | Briquet | Sodium Tripolyphosphate | FD & C Green #3 | 15:1 | 2:1 | 2–5 ppm |
| XIII | Calcium Hypochlorite | Granular | Sodium Tripolyphosphate | FD & C Green #3 | 15:1 | 2:1 | 2–5 ppm |
| XIV | Calcium Hypochlorite | Cake | Sodium Tripolyphosphate | FD & C Green #3 | 15:1 | 5:1 | 1–2 ppm |
| XV | Sodium Dichloroisocyanurate | Tablets | Sodium Tripolyphosphate | FD & C Green #3 | 15:1 | 2:1 | 2–5 ppm |
| XVI | Sodium Perborate | Tablets | Sodium Tripolyphosphate | FD & C Green #3 | 15:1 | 2:1 | 2–5 ppm |

FIGS. 12 and 13 illustrate the ability of dispensers of the invention to retain disinfecting properties after repeated intermittent flushes as shown in FIG. 12 and after consecutive flushes (as shown in FIG. 13). The advantages of these dispensers over air lock systems in this regard is noted.

Figure 14:
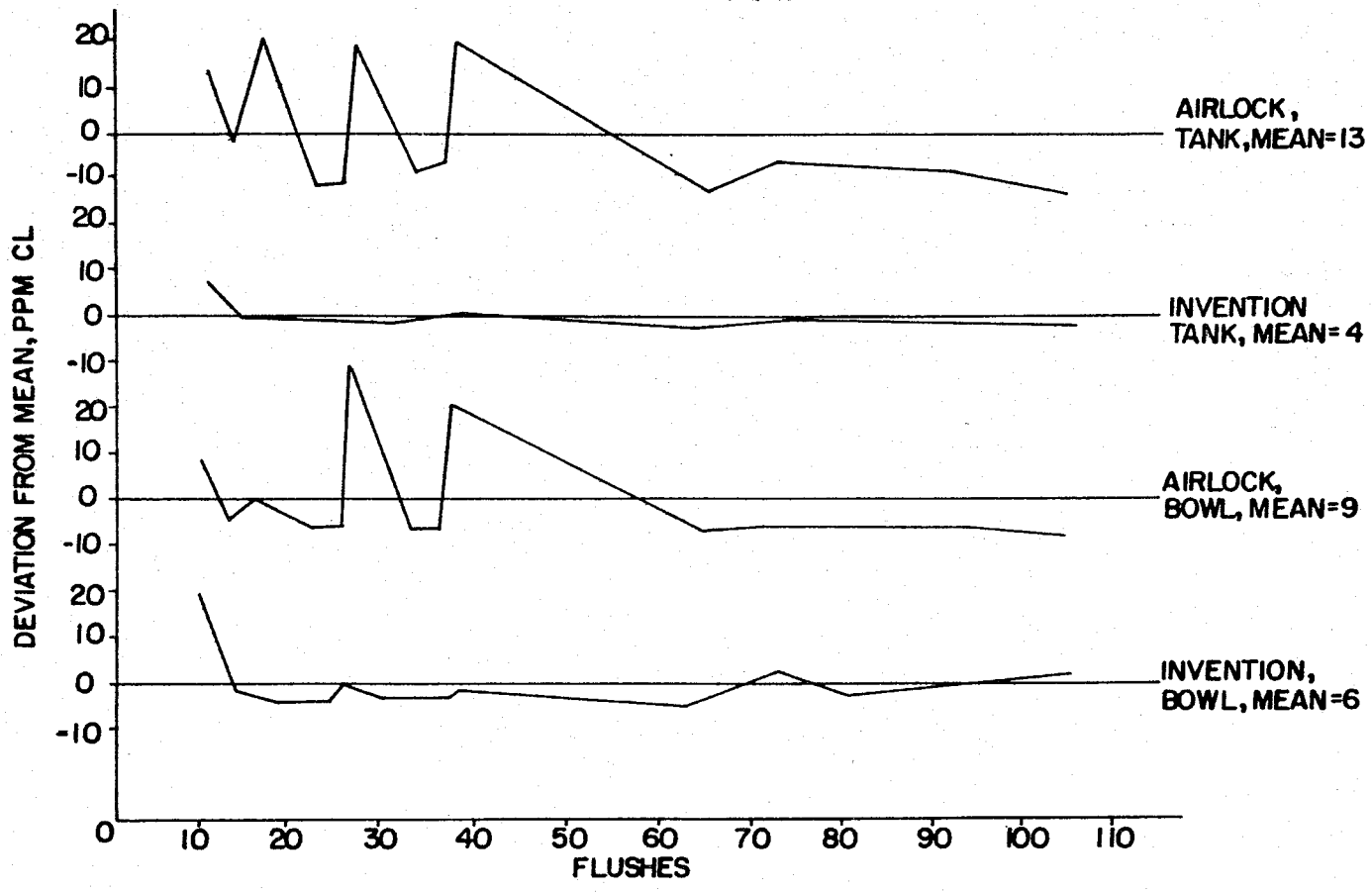
FIG. 14 provides a graphical comparison of systems embodying the invention and systems made pursuant to U.S. Pat. No. 4,208,747, the graphs showing average deviation from the mean dispensing concentration of the disinfectant.

The described structure and operation is also responsible for the consistent dispensing properties over time and a surprisingly low deviation from mean dispensing concentration as shown in FIG. 14. Again, a favorable comparison with air lock type systems is apparent When preparing FIG. 12, standard iodometric titrations were used to establish chlorine concentrations. The procedure used was to flush the toilet, draw samples from the bowl and tank, and analyze immediately. This was repeated at ½ hour intervals. For FIG. 13 the same procedure was followed except the consecutive flushes were analyzed in increments of 5.

For FIG. 14, the mean flush level was obtained by flushing a number of times per day. The chlorine analysis was done at least once per day. The results of each chlorine analysis was multiplied by the number of flushes since the previous analysis. These products were totalled and divided by the total flushes to yield the mean.

It will be understood that various changes and modifications may be made in the above-described invention without departing from the spirit thereof as defined in the following claims.

I claim:

1. A method for cleansing and disinfecting a toilet tank and toilet bowl by treating the water discharged from the toilet tank each time the toilet is flushed, said method comprising the steps of providing a dispenser having means for hanging the dispenser in a toilet tank, a dispenser reservoir, a source of disinfectant soluble in water located in said reservoir, a volume control chamber communicating with said reservoir, a delivery tube vented to the atmosphere, a dispensing orifice defined by the delivery tube, and a passage defined between said delivery tube and said reservoir, placing said dispenser in said toilet tank in a position such that said orifice is located beneath the normal level of water in the tank when the apparatus is placed in the tank, water being thereby introduced through said orifice, and said delivery tube being thereby placed in dynamic fluid communication with water in the toilet tank, the water then passing into said reservoir and into said volume control chamber and rising to the level of water in the tank, flushing said toilet to achieve dropping of the water level in said tank below said dispensing orifice whereby the head of water in said volume control chamber forces a dose of aqueous disinfectant solution through said dispensing orifice and into said tank and maintaining the reservoir in fluid communication with the discharge orifice with no air-lock therebetween whereby disinfectant is dispensed even during extended quiescent periods.

2. A method in accordance with claim 1 including providing hanger means for supporting the dispenser on a wall of said toilet tank, and adjusting the position of said dispenser relative to said hanger means and relative to said normal level of water for controlling the volume of said dose.

3. A method in accordance with claim 1 wherein the dynamic fluid communication provided by said dispensing orifice achieves a minimum entry of aqueous disinfectant solution into said tank during periods between flushes.

4. A method in accordance with claim 1 wherein the ratio of the volume of said reservoir to the volume of said dose dispensed is between about 5:1 to 50:1 whereby a sufficient amount of disinfectant solution is available for dispensing even after frequent successive flushes.

5. A method in accordance with claim 1 including the step of minimizing the passage of water between said volume control chamber and reservoir except during a flush to thereby minimize the concentration of disinfectant in said volume control chamber.

6. A method in accordance with claim 5 including the step of providing a solid coloring agent soluble in water located in said volume control chamber, amounts of solution including said coloring agent being passed from said volume control chamber to said reservoir, said disinfectant being operable to bleach the color developed by said coloring agent whereby color is substantially absent from a dose for as long as bleaching amounts of disinfectant are present in said reservoir.

7. A method in accordance with claim 1 including the step of providing a pair of normally closed ports defined by said delivery tube, said ports being located at different levels relative to said normal level of water in the tank, and opening one of said ports to provide said dispensing orifice, the particular port opened determining the volume of said dose upon flushing of the toilet.

8. A method in accordance with claim 7 including providing a water level indicator on said dispenser, and positioning said dispenser relative to said normal level of water by using said indicator.

9. A method in accordance with claim 1 wherein aerosols generated in the vicinity of said toilet and tank by the flushing of said toilet comprise aerosols treated with said aqueous disinfectant solution for as long as amounts of said disinfectant are present in said dispenser.

10. A method in accordance with claim 9 wherein aqueous disinfectant solution is in fluid communication with said tank during quiescent periods between flushes whereby the disinfectant is dispersed in small amounts independently of flushing during such periods and whereby amounts of the disinfectant remain present in the tank and toilet water during such periods.

11. A method in accordance with claim 1 including the step of adding a separate ingredient to said tank treatment of the tank water independently of said disinfectant.

12. A method in accordance with claim 11 wherein a separate chamber is provided on said dispenser, an opening defined by said separate chamber communicating the interior of the separate chamber with the tank water, and locating said separate ingredient in said separate chamber.

13. A method in accordance with either of claims 11 or 12 wherein said separate ingredient comprises a sequestering agent adapted to react with contaminants in said tank which would otherwise interfere with the action of said disinfectant.

* * * * *